US006774343B2

(12) United States Patent
Ibanez

(10) Patent No.: US 6,774,343 B2
(45) Date of Patent: Aug. 10, 2004

(54) TOWEL AND GARMENT WARMER

(76) Inventor: Rene L. Ibanez, 3520 Jermantown Rd., Fairfax, VA (US) 22030

( * ) Notice: Subject to any disclaimer, the term of this patent is extended or adjusted under 35 U.S.C. 154(b) by 0 days.

(21) Appl. No.: 10/336,258

(22) Filed: Jan. 3, 2003

(65) Prior Publication Data

US 2003/0155343 A1 Aug. 21, 2003

Related U.S. Application Data

(60) Provisional application No. 60/357,820, filed on Feb. 21, 2002.

(51) Int. Cl.[7] ..... F27D 11/00

(52) U.S. Cl. ..... 219/386; 219/411

(58) Field of Search ..... 219/385, 386, 219/395, 411, 521, 392; 221/150 A

(56) References Cited

U.S. PATENT DOCUMENTS 2,662,964 A * 12/1953 Simms ..... 219/417
3,902,044 A * 8/1975 Doyle et al. ..... 392/336
4,675,506 A * 6/1987 Nusbaum et al. ..... 219/411
D301,923 S * 6/1989 Koschuta ..... D23/332
4,918,290 A * 4/1990 DeMars ..... 219/400
5,004,894 A * 4/1991 Whitehead ..... 219/521
6,005,227 A * 12/1999 Pappas ..... 219/400
6,018,145 A * 1/2000 Moreno ..... 219/401
6,179,162 B1 * 1/2001 Motsenbocker ..... 221/150 A
6,525,298 B1 * 2/2003 Hunts ..... 219/400
6,667,464 B2 * 12/2003 Ellis ..... 219/400

* cited by examiner

*Primary Examiner*—J. Pelham

(57) ABSTRACT

A towel and garment warmer is provided. The warmer includes a top-opening cabinet having a upper section that is provided with a rack for holding the items to be warmed, and a lower heating section. The two sections are separated one from the other by means of a removable, air permeable grid or screen. Heating is accomplished using an electrical resistance heater such as one or more incandescent light bulbs. An interval timer controls the degree of warming imparted to the items within the cabinet.

5 Claims, 1 Drawing Sheet

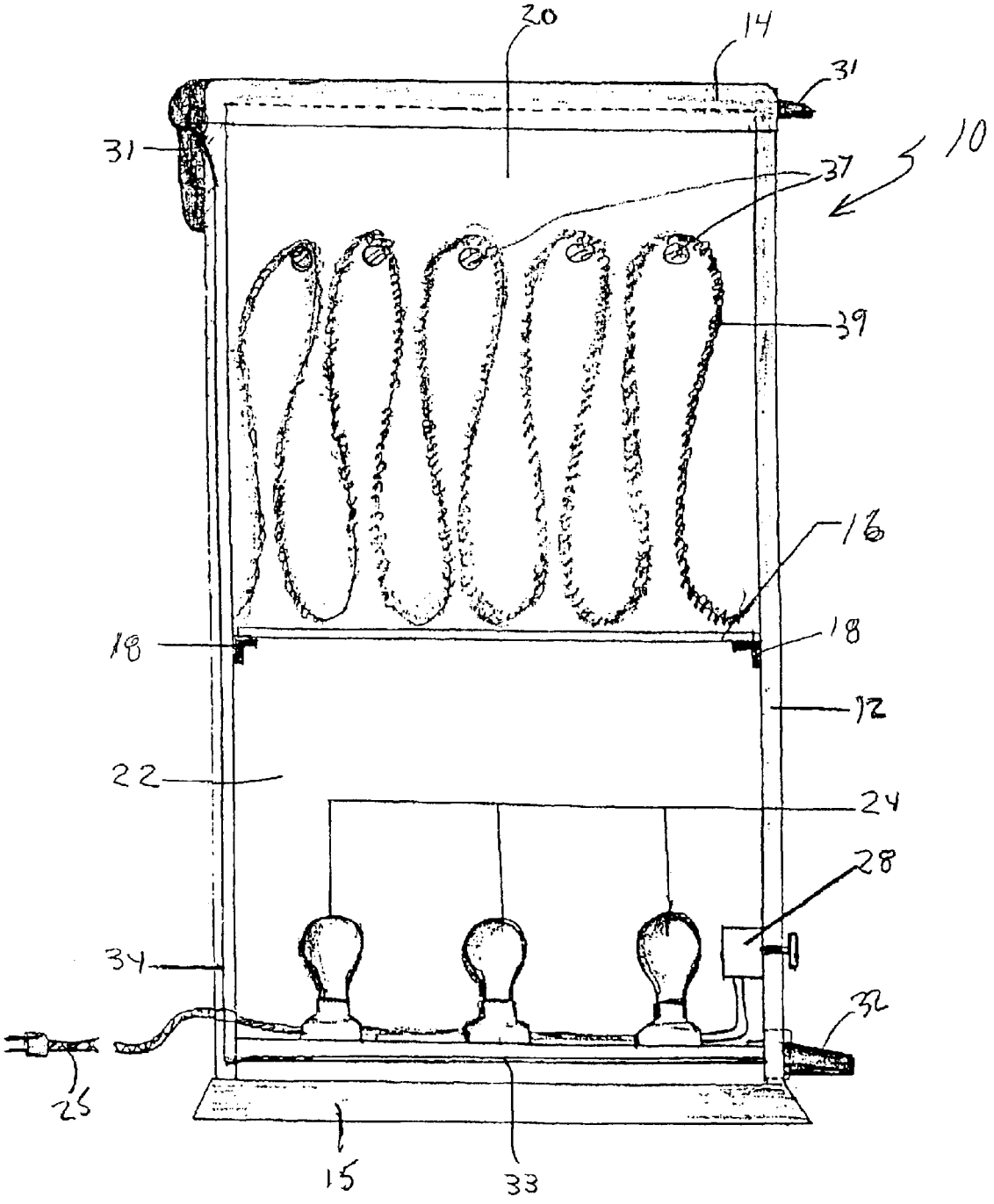
20
14
31
31
10
37
39
16
18
18
12
22
24
28
34
32
25
15
33

TOWEL AND GARMENT WARMER

REFERENCE TO RELATED APPLICATION

This application claims the benefit of U.S. Provisional Patent Application No. 60/357,820 filed Feb. 21, 2002.

BACKGROUND OF THE INVENTION

1. Technical Field

This invention relates to a means for warming towels and garments in preparation for their use.

More particularly, this invention relates to a warming means that includes a chamber for towels or other garments and having means to impart a controlled degree of warming to the chamber contents.

2. Description of Related Art

It is known in the prior art to provide racks that warm towels either by direct contact between the towel and a heated rack member or by blowing a stream of warmed air at or through the towel. It is also known to provide a cabinet means arranged to support shoes or other footwear above a radiant heat source as is shown in U.S. Pat. No. 2,662,964.

This invention provides a means for conveniently providing warmed towels or garments for use after bathing and at other appropriate times.

SUMMARY OF THE INVENTION

This invention provides a towel or garment warming device that includes a cabinet having an upper chamber adapted for holding the items to be warmed and a lower section holding heating elements. The heating elements may suitably comprise one or more incandescent light bulbs that are controlled by an interval timer so as to impart the desired level of warmth to the items contained within the chamber. An air permeable separation means, suitably a metal screen or mesh member, is disposed at the bottom of the upper chamber to prevent accidental contact of the items being warmed with the heating elements.

Hence, it is an object of this invention to provide a towel and garment warmer that is suitable for safe and convenient use in home bathrooms and like locales.

Other objects and advantages of this invention will become evident from the following disclosure and description of certain preferred embodiments.

BRIEF DESCRIPTION OF THE DRAWING

The sole FIGURE is a frontal, cross-sectional view of the towel and garment warmer of this invention.

DESCRIPTION OF PREFERRED EMBODIMENTS OF THE INVENTION

The towel and garment warmer of this invention provides a convenient and safe means for warming towels and other garments for use after showering or bathing. It will be described with reference to the FIGURE where a preferred embodiment of this invention is shown at 10.

Warmer 10 comprises a circular, or oval, or generally rectangular cabinet 12 including a front, rear and sides, and having an openable top lid or cover 14 and a base member 15. Cabinet 12 may be free standing or it may be mounted within a wall recess of appropriate size and shape. A removable, air permeable grid or screen tray 16, preferably of metal construction, is supported upon brackets 18 in a generally horizontal attitude and serves to divide the interior of cabinet 12 into an upper warming chamber 20 and a lower heater section 22. Screen 16 must be sufficiently rigid to support the weight of items placed within chamber 20. One or more heating elements are located within section 22. Those heating elements may comprise any heat-producing electrical resistance, but preferably consist of one or more incandescent lights 24. Access to lights 24 for cleaning and bulb changing is obtained by removing screen 16. Electrical power is provided to the heating elements by way of a plug-terminated cord 25. The temperature reached and maintained within chamber 20 is controlled by selecting the wattage of the heating element or elements, illustrated as incandescent lights 24, and by controlling the heating interval by means of timer 28. Furthermore, the walls of cabinet 12 may be insulated to reduce heat losses from the cabinet interior.

The top of cabinet 10 is preferably connected at its rear side to the back cabinet wall by way of hinges 31 so that the front side of the cabinet top lifts upwardly and backwardly to give access to the interior of the warming chamber 20. If desired, the cabinet top can be arranged to be opened through a downward movement of a foot pedal 32 that is connected through a shaft 33 and lever means 34 to the cabinet top.

The items to be heated may simply be crumpled and placed within the warming chamber 20, and this embodiment is generally preferred because of its simplicity and practicality. In another optional embodiment, one or more rack members 37 may be disposed near the top of warming chamber 20 to hold towels or other fabric items 39 in a loosely draped attitude so as to allow those items to be uniformly warmed by the heating elements 24. Rack members 37 may appropriately comprise a plurality of parallel rods that are preferably easily removable extending between the front and rear of chamber 20 or, alternatively, from one side of the chamber to the other. This embodiment works best when cabinet 12 is of generally rectangular shape.

As may be appreciated from the foregoing description, this invention provides a simple and practical means for warming towels and items of clothing. It has been described in relation to preferred embodiments thereof that are illustrated in the drawing FIGURE. It is to be understood that variations and modifications of the invention, other than those specifically described, will be apparent to those skilled in the art and are included within the scope of the invention as defined by the following claims.

I claim:

1. A device for warming towels and other fabric items comprising:

a cabinet having an openable top lid, said cabinet including a chamber arranged to hold said items disposed in the upper area thereof and a heating section disposed below said chamber;

a removable, air permeable grid means disposed in a generally horizontal attitude intermediate the top and bottom of said cabinet, said grid means separating the chamber from the heating section;

heating means disposed in said heating section, said heating means comprising one or more incandescent bulbs.

2. The device of claim 1 including timer means that define the interval during which heating is provided to said cabinet.

3. The device of claim 1 wherein said grid means comprises a metal screen member.

4. The device of claim 1 wherein said chamber top is hinged at its rear side to thereby open upwardly to provide access to the interior of said chamber.

5. The device of claim 1 wherein said cabinet is of generally rectangular shape and is mounted within a wall recess.

* * * * *